United States Patent [19]

Hechtel et al.

[11] Patent Number: 4,794,303

[45] Date of Patent: Dec. 27, 1988

[54] AXISYMMETRIC ELECTRON COLLECTOR WITH OFF-AXIS BEAM INJECTION

[75] Inventors: Johann R. Hechtel, Redwood City; Ronald W. Herriott, San Bruno, both of Calif.

[73] Assignee: Litton Systems, Inc., Woodland Hills, Calif.

[21] Appl. No.: 6,010

[22] Filed: Jan. 22, 1987

[51] Int. Cl.[4] ..... H01J 23/02

[52] U.S. Cl. ..... 315/5.38; 315/5.35

[58] Field of Search ..... 315/3.5, 5, 3.6, 5.24, 315/5.25, 5.34, 5.38

[56] References Cited

U.S. PATENT DOCUMENTS

| | | | |
|---|---|---|---|
| 3,368,104 | 2/1968 | McCullough | 315/5.38 |
| 3,644,778 | 2/1972 | Mihran et al. | 315/5.38 |
| 3,764,850 | 10/1973 | Kosmahl | 315/5.38 |
| 3,936,695 | 2/1976 | Schmidt | 315/5.38 |
| 4,096,409 | 6/1978 | Hechtel | 315/3.5 |
| 4,250,430 | 2/1981 | Heynisch | 315/5.38 |
| 4,398,122 | 8/1983 | Gosset | 315/3.5 |
| 4,527,092 | 7/1985 | Ebihara | 315/3.5 |

*Primary Examiner*—David K. Moore
*Assistant Examiner*—Mark R. Powell
*Attorney, Agent, or Firm*—Poms, Smith, Lande & Rose

[57] ABSTRACT

An electron collector is shown having four axisymmetric electrodes with off-axis apertures therein which receive an electron beam. The application of a consecutively smaller voltage to each electrode as compared to the cathode that generates the electron beam creates an electrostatic field that efficiently deflects the beam electrons onto the electrodes for their collection.

17 Claims, 4 Drawing Sheets

AXISYMMETRIC ELECTRON COLLECTOR WITH OFF-AXIS BEAM INJECTION

The present invention relates to a charged-particle collector and, more particularly, to a multistage depressed electron collector which is axisymmetrical with off-axis beam injection.

BACKGROUND OF THE INVENTION

Many electronic devices employ a traveling stream of charged-particles, such as electrons, formed into a beam as an essential function in the device's operation. For example, one type of vacuum device, a microwave traveling wave tube, incorporates a source of electrons that are formed into a beam, in which the electrons are accelerated to a predetermined velocity and directed along an axial path through an "interaction" region within the microwave tube body. In the interaction region, kinetic energy is transferred from the moving electrons to the high frequency electromagnetic fields, such as microwave signals, that are propagating along a slow wave structure through the interaction region at about the same velocity as the moving electrons. The electrons give up energy to the microwave field through the exchange process characterized as electronic interaction, evidenced by a lower velocity of the electrons exiting from the interaction region. The "spent" electrons pass out of the interaction region where they are incident upon and collected by a final tube element, termed the collector. The collector collects and returns the incident electrons to the voltage source. As is recognized, much of the energy in a moving particle is released in the form of heat when the particle strikes a stationary element, such as the collector. This produces undesired heating in the microwave tube and a lower overall electrical efficiency of microwave tube operation.

The depressed collector and, more particularly, the multistage depressed collector is a collector that increases the electrical efficiency of traveling wave tube operation as well as reduces undesireable heat generation by a process of velocity sorting of the electrons controlled by a retarding electric field. The field slows the electrons so that the electrons are collected by electrodes at a reduced velocity and ideally at a zero velocity. As is known to those skilled in the art, the multistage depressed collector is characterized physically by a series of spaced metal electrodes, each containing a passage therethrough, a final electrode and a passage entry for receiving electrons. The electrodes are maintained at successively lower voltages with respect to the tube circuit taken as ground (or at successively higher negative voltages as otherwise viewed) so as to present a retarding electric field to the electrons which pass through the entrance into the collector region. Such types of devices are substantially well developed and hence are complex in nature as is known to the reader skilled in the art.

One type of known multistage depressed collector employs a combination of a transverse electric field and a longitudinal magnetic field for sorting electrons as a function of electron velocity. See U.S. Pat. No. 3,526,805, by Okashi, et al.; No. 3,644,778, by Mihran, et al.; and No. 3,702,951, by Kosmahl. Another type of collector employs a retarding electric field established by a cuplike electrode and a pointed spike located in the center of the cuplike member. The effect of this structure with a voltage applied is to present an electron mirror with a negative focal length to electrons moving near the axis. Hence, the reflected beam is more divergent than the incident beam. See the paper entitled *Multistage Depressed Collector Investigation For Traveling Way Tubes,* Tammaru, NASA CR-72950 EDDW-3207, Contract NAS-3-11536, Final Contract Report.

The efficiency of the NASA collector is limited by the defocusing properties of the spikelike reflector. Further, the collectors shown in the patents mentioned above required the maintenance of an axial magnetic field of a critical magnitude for proper functioning.

An improved multistage depressed collector utilizing electrodes that are asymmetrical was disclosed in U.S. Pat. No. 4,096,409, by Hechtel, which is assigned to the same assignee as the present invention. This electron collector has a high efficiency and utilizes the concept of focusing electrons to collection points on various electrodes depending upon the energy level of the electron. One disadvantage of the Hechtel patent is that it is difficult to fabricate and align the various asymmetric electrodes.

SUMMARY OF THE INVENTION

Accordingly, an object of the present invention is to provide a multistage electron collector that is easily fabricated and has an efficiency that is as good as or better than the prior art electron collectors.

The novel multistage electron collector of the present invention is formed from a series of electrodes, the first of which forms an electron entry wall; while the final electrode forms a back wall of the electron collector which is sealed by appropriate side walls located between the first and final electrodes. Also, located between the first and final electrodes may be one or more further electrodes which, along with the first and final electrode, are all symmetrical about a common axis which forms the longitudinal axis of the electron collector. The first or entry electrode has an electron receiving aperture therein that is offset from the longitudinal axis of the axisymmetrical electrode. Similarly, additional electrodes may be provided with apertures which may or may not be offset to form a passageway for the electrons that is offset or off-axis from the longitudinal axis of the electron collector. The axisymmetrical electrodes form an axisymmetrical electrostatic field when the electrodes are connected to a voltage potential. This field serves to focus the electrons entering the collector upon the various electrodes depending upon the energy level of each electron.

BRIEF DESCRIPTION OF THE DRAWINGS

A better understanding of the present invention will be had after careful review of the following specification and accompanying drawings, wherein.

DESCRIPTION OF THE PREFERRED EMBODIMENTS

Figure 1:
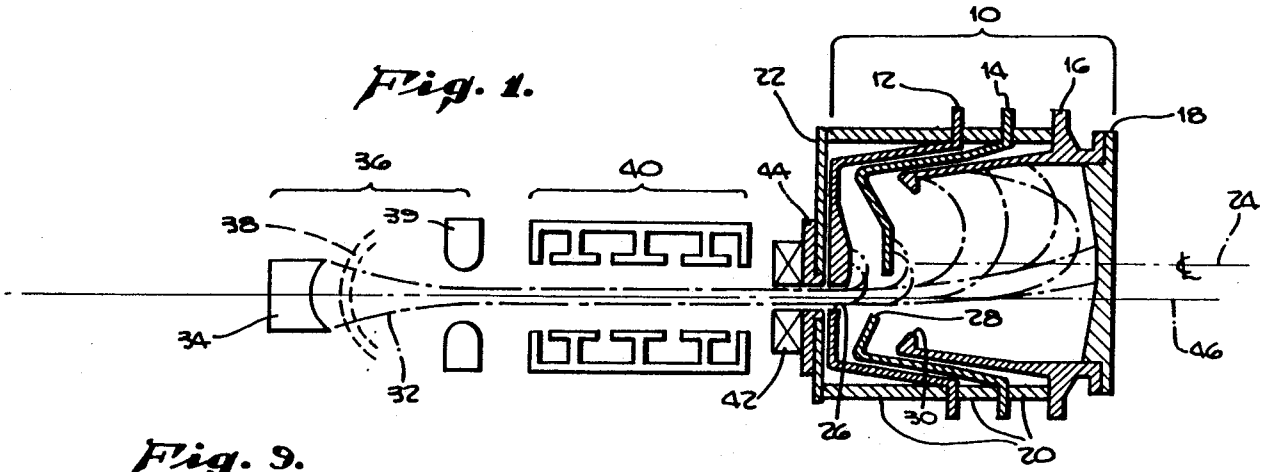
FIG. 1 is a schematic diagram showing an electron collector of the present invention as it might be used with a microwave tube and an electron gun.

Referring now to the drawings, FIG. 1 shows a charged-particle collector 10 which may be used to collect electrons having a plurality of electrodes 12, 14, 16, and 18 formed from a metal such as copper, into a generally cuplike shape with each electrode nested into the other. While four electrodes are shown, as few as two and more than four electrodes may be used within the present invention. The left-most electrode 12 forms a particle entry wall of the collector 10, while the right-most electrode 18 forms the furthest electrode or back wall of the collector 10. The side walls of collector 10 are formed by ceramic cylinders 20 which mechanically separate and electrically isolate one electrode from the other. In some applications, electrodes 12 and 18 may be the only two electrodes required for the collector 10. Mounted at a slight distance from electrode 12 is a mounting plate 22 which may be fabricated from an insulating material.

As seen in FIG. 1, the electrodes 12–18 are all symmetrical about a centerline 24 which forms the longitudinal axis of the collector 10. Electrodes 12, 14, and 16 are each provided with apertures; 26, 28 and 30, respectively, through which an electron beam 32 generated from a cathode 34 passes. It will be noted that apertures 26, 28 and, in some cases, 30 are offset from the axis 24 of the electron collector 10 for providing an off-axis injection of electron beam 32.

As is well known in the art, the electron beam 32 is generated by an electron gun 36 which may comprise a cathode 34, control grids 38, and an anode 39. As the beam 32 exits the electron gun, it is directed into a vacuum device 40, such as a microwave device or, more particularly, a traveling wave tube. The spent electrons exit the microwave device 40 where they may be refocused by a magnetic field formed by permanent magnet 42 and/or an exit anode 44. The exit anode 44 may be mounted in close proximity to the left-most electrode 12 and is provided with an aperture therein which is in alignment with the offset aperture 26 of electrode 12. By reference to FIG. 1, the reader will now see the offset between an aixs 46 of electron beam 32 and the centerline 24 of the electron connector 10.

It will be understood that the precise configuration of the electrodes 12–18 within the electron collector 10 may vary as well as the number of such electrodes. The important feature of the electrodes 12–18 is that they focus the electron beam. Focus means a selective focus wherein different electrons which make up the beam 32 are selected by energy level for shunting within a generally circular area upon different and separate electrodes. In theory, an infinite number of electrodes provide a target for an infinite number of electron energy levels so that each electron strikes an appropriate electrode with a zero velocity. In practice, the infinite number of electrodes is reduce to meet the need for a simplified design.

The key difference between the preferred embodiments described herein and the prior art is that many of the prior art devices rely on defocusing the electron beam which has a tendency to scatter the electrons into an annular area about the outer surfaces of the collector. Thus, electrons having the same energy level but traveling at different angles into the collector will land on different points around the peripheral inner surface of the collector. The concept of focusing the beam requires that two electrons with the same energy but a different entrance angle will land in the same circular area of an electrode, see FIG. 6. This concept permits higher efficiency within the electron collector. The prior art U.S. Pat. No. 4,096,409 utilized this concept of focusing. However, the asymmetric, two-dimensional multistage collector disclosed therein is more difficult to build than conventional multistage collectors. The advantage of the novel axisymmetric collector of the present invention is that it is easy to fabricate and has the same efficiency as the prior art asymmetric collector.

A basic equation which describes the electrostatic field, V, for the collector 10 shown and described in FIG. 1, is:

$$V=\tfrac{2}{3}z+\tfrac{1}{2}z^2-1/12z^4-\tfrac{1}{4}r^2+\tfrac{1}{4}r^2z^2-1/32r^4$$

where the electrostatic potential, V, is described in an r, z-coordinate system. R is the radius from the longitudinal axis 24 of the collector 10, while z is the length along that axis. On the axis where r=o, the potential is:

$$V_{r=o}=-\tfrac{2}{3}z+\tfrac{1}{2}z^2-1/12z^4$$

Its first derivative is:

$$(\partial V/\partial z)_{r=o}=-\tfrac{2}{3}+z-\tfrac{1}{3}z^3$$

while its second derivative is:

$$(\partial^2 V/\partial z^2)_{r=o}=1-z^2$$

Figure 2:
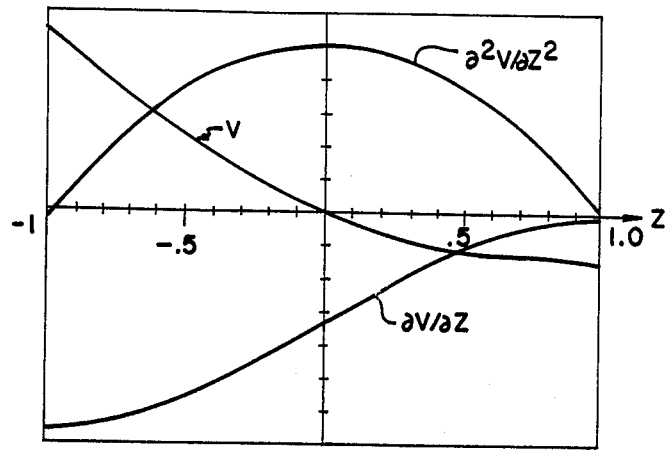
FIG. 2 is a curve showing the magnitude of the electrostatic field, V, and its first and second derivatives along the centerline (z axis) of an electron collector having focusing properties.

FIG. 2 shows V, $\partial V/\partial Z$, and $\partial^2 V/\theta Z^2$ for the range of $z=-1$ to $+1$. Note, from FIG. 2 that $\partial^2 V/\partial Z^2$ is positive over the entire range which is equivalent to the focusing action on the beam 32.

Figure 3:
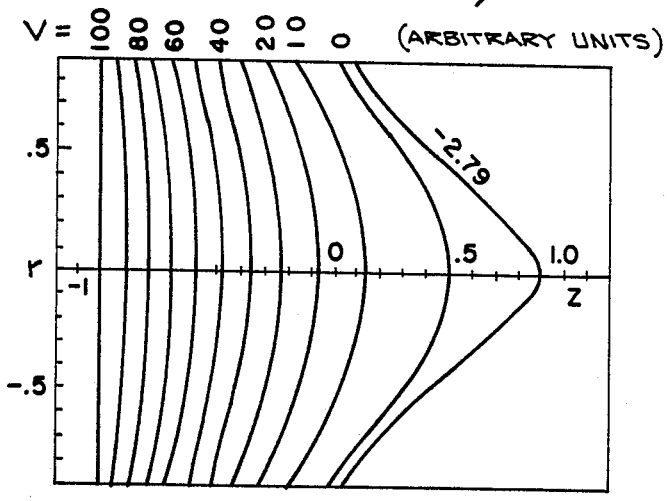
FIG. 3 shows equipotentials at a radius, r, along the z axis of an axisymmetric electron collector.

FIG. 3 shows the equal potentials V, measured in arbitrary units, in an r vs. z system between $z=-1$ and $z=0.9$. In designing a multistage collector, any equal potential surface can be substituted by a conducting electrode at the proper potential. Thus, the configuration of the focusing electrodes follows to some extent the contours shown in FIG. 3.

Figure 4:
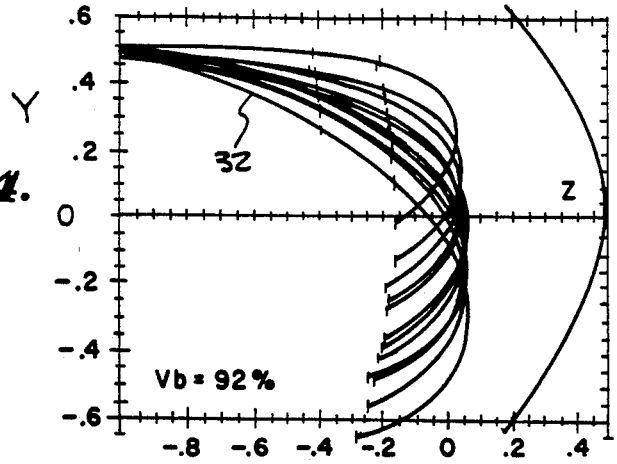
FIG. 4 illustrates a computer generated projection of the electron trajectories on the y, z-plane of an electron collector.

Using a computer to project the various trajectories of an off-axis electron beam 32 as its enters the electron collector 10, it is possible to plot curves similar to that shown in FIG. 4 wherein a plot representing the projections of the electron trajectories on the y, z-plane is shown. FIG. 4 shows an electron beam 32 entering parallel to the longitudinal axis 24 of the collector 10 and assumes that all electrons within the beam have the same energy level which is 92% of the cathode voltage.

Figure 5:
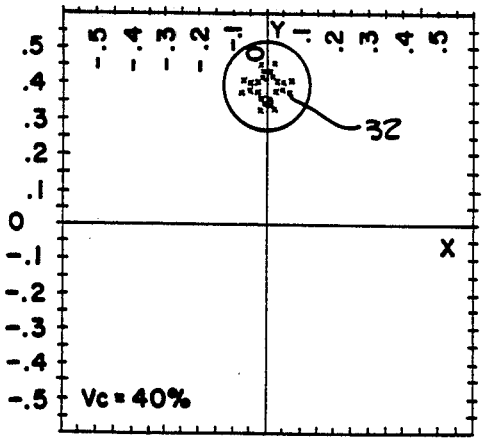
FIG. 5 is a computer generated projection of the electron trajectories of FIG. 4 in the x, y-plane at a potential of 40% of circuit potential with respect to cathode.
Figure 6:
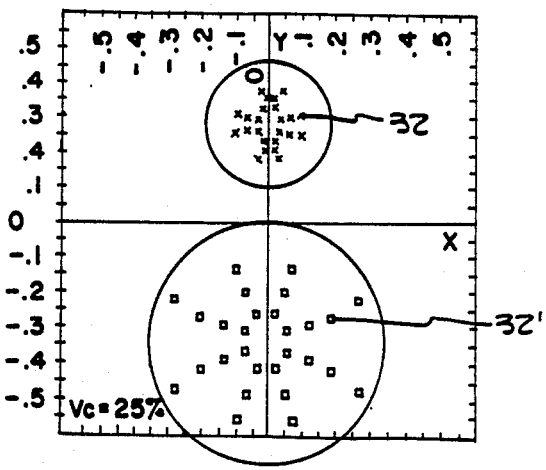
FIG. 6 is a computer generated projection similar to FIG. 5, showing electron trajectories in the x, y-plane at a potential of 25% of circuit potential with respect to cathode.

A plot of the electron beam 32 in the x, y-plane at a particular z position is shown in FIG. 5. FIG. 5 shows the intensity of beam 32 as it passes into the electron collector 10 at a point where the potential of the electrostatic field is approximately 40% of the cathode. Similarly, FIG. 6 shows the pattern of the beam 32 at a point where the beam has a potential of 25% with respect to the cathode. Note, that the beam 32 includes two trajectory areas including a first area shown in the upper surface where the beam 32 is moving from left to right (FIG. 4) and a second portion wherein the beam 32' is moving from right to left. The return beam 32' is shown by squares which represent theoretical strike points of the spent electrons.

It will now be understood from referring to FIGS. 4–6 that electrons entering the electron collector 10 are focused in a generally circular area upon the rear or inner surfaces of the electrodes 12–16 depending upon the energy level of each electron.

Figure 7:
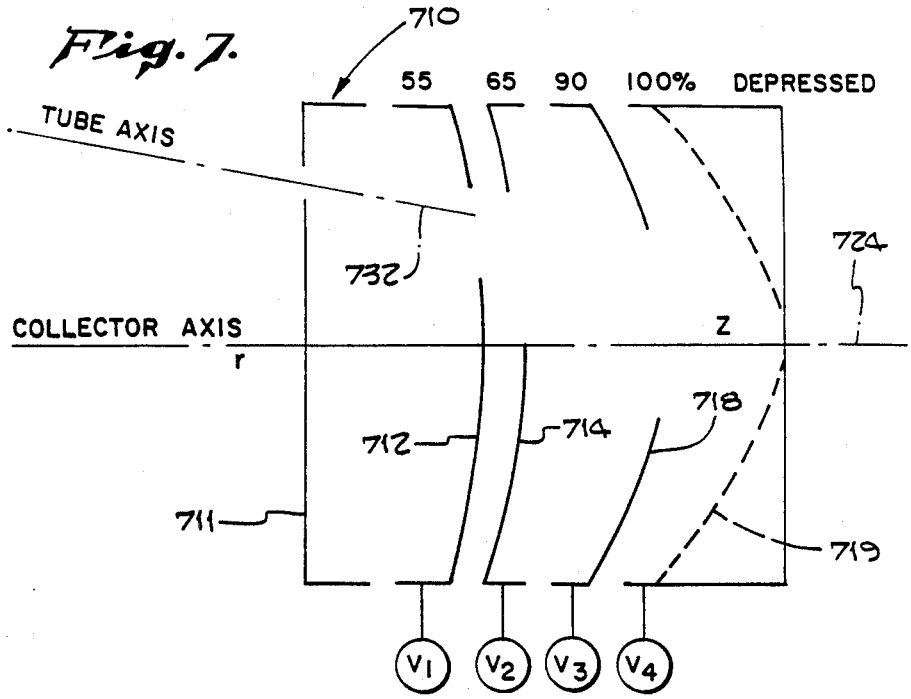
FIG. 7 is a schematic, cross-sectional diagram of one embodiment of an electron collector along the r, z-plane thereof, showing the off-axis electron beam at an angle to the axis of the collector.

Referring to FIG. 7, a schematic design of a suitable electron collector 710 is shown having a plurality of electrodes 711, 712, 714, 718, and 719. Note, how the configuration of the electrode 712, 714, 718, and 719 comply with the equipotential lines shown in FIG. 3. In the design shown in FIG. 7, the potential applied to electrode 712 is 55% of the cathode voltage from ground or plus 45% when compared to the cathode voltage. Similarly, the voltage on electrode 714 is plus 35%, the voltage on electrode 718 is plus 10%, and the voltage on electrode 719 is 0 with respect to the cathode. That is, the grid 719 is 100% depressed. The electron beam 732 is offset from axis 724 and is shown entering electron collector 710 at an angle to the collector axis 724 of approximately 10°, although other angles between 6° and 14° may be used.

Through experimentation, it was unexpectedly found that the zero voltage grid 719 is unnecessary within the present invention. That is, the electrode 719 which is 100% depressed has a tendency to turn the electrons around and send them back through the opening within the electron collector 710. Thus, it was unexpectedly found that the elimination of the 100% depressed electrode 719 not only retained the efficiency of the electron collector 710 but, in fact, improved it. Further, by experimentation, it was found that the efficiency of the electron collector remained the same whether the electron beam 732 entered the collector 710 at an angle, as shown in FIG. 7, or entered the collector parallel to its axis 724. This unexpected result was extremely useful as it simplifies the design of the collector. This simplified design makes it possible to fabricate all electrode axisymmetrically about the centerline 724. The only feature of the electrodes that is not axisymmetrical is the offset apertures for the electron beam 732.

Figure 8:
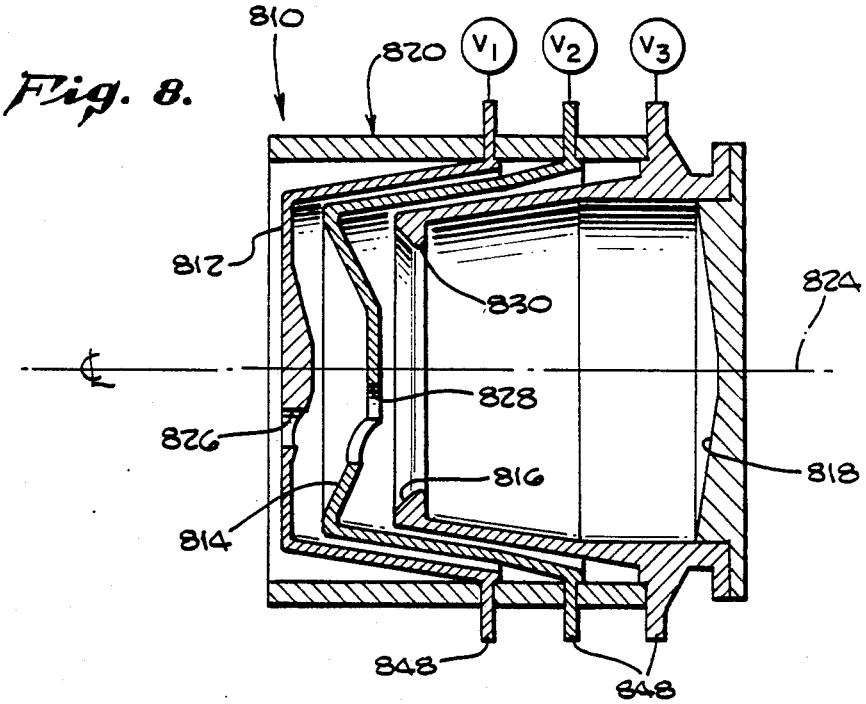
FIG. 8 shows the preferred embodiment of the electron collector of the present invention in crosssection.

Referring now to FIG. 8, the preferred embodiment of the present invention will be described in greater detail. The electron collector 810 shown in FIG. 8 includes four electrodes 812, 814, 816, and 818. These cuplike metal electrode are provided with outwardly extending flanges 848 which are mechanically and electrically separated from each other by insulators 820. The insulators 820 may be attached to flanges 848 by any suitable device such as by chemical bonding or electrical welding. The reader should note that electrodes 812, 814, 816, and 818 are symmetrical about a centerline 824 but for the apertures 826 and 828 in the left-most electrodes. Aperture 826 in electrode 812 is offset from the centerline 824 by a significant distance; while aperture 818 in electrode 814 is offset by a slightly smaller distance, although the aperture 818 is significantly larger. Experimentation has unexpectedly shown that it is not necessary to offset each of the apertures within the later stages of the electron collector. Thus, the aperture 830 in electrode 816 is shown as symmetrical even though it is utilized to capture an electron beam, such as beam 32 in FIG. 1 which is entering off-axis to the centerline 824 of the collector 810. The offset apertures 826 and 828 are circular in shape within the preferred embodiments. However, other shapes such as elliptical or oval may also be used.

The left-most surface of electrode 812 is shown flat, while the inner surface thereof is made thicker toward the centerline 824 for purposes of focusing the electron beam. Similarly, the left-most surface of electrode 814 is dished; while the inner surface thereof is arranged in a parallel configuration thereto. This aids in focusing the beam 32 (FIG. 1). The aperture 828 passes through the flat portion of the dish in electrode 814 as well as part of the tappering surface thereof. Aperture 830 in electrode 816 is symmetrical, as stated above. The reader will note that the electrode 818 which forms the final electrode or rear wall of collector 810 is maintained at the same potential as electrode 816. As stated above, it was unexpectedly discovered that it is not desirable to depress the final electrode to a potential equal to the cathode. Rather, a potential slightly positive compared to the cathode is desirable for improved efficiency.

In one of the preferred embodiments, the first electrode 812 was retained at 58% of the cathode voltage from ground, the second electrode 814 was retained at 80% of the cathode voltage from ground, and the third electrode 816 was maintained at 90% of the cathode voltage from ground along with electrode 818. The range of voltage on electrode 812 may vary from 30 to 65% of the cathode voltage from ground, the voltage on electrode 814 may vary from 55 to 85%, and the voltage on electrodes 816 and 818 may vary from 80 to 100%. However, as previously stated, it is preferred to retain the voltage on electrodes 816 and 818 at less than 100% of the cathode voltage from ground.

Figure 9:
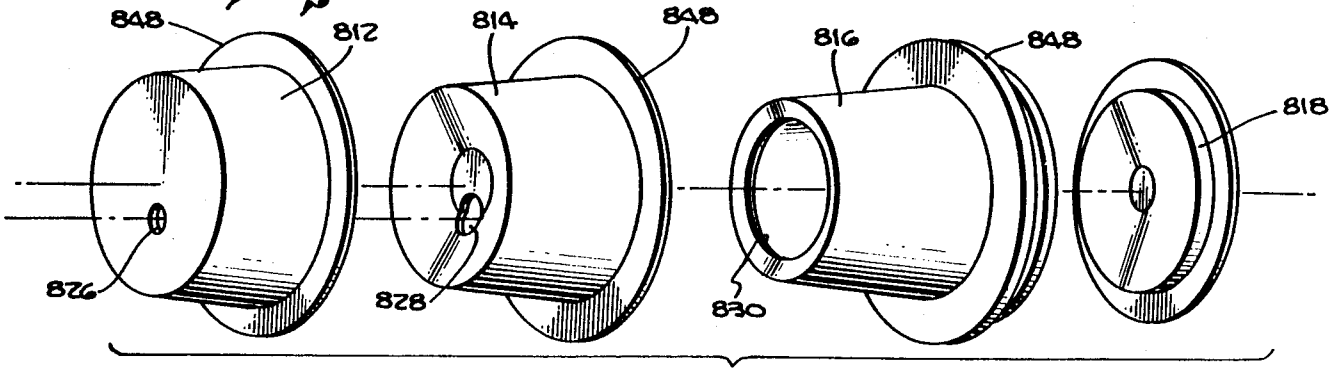
FIG. 9 is an exploded view of the electrodes used in FIG. 8.

FIG. 9 shows the electrodes of FIG. 8 in an exploded view to more clearly demonstrated the relationship of the off-axis beam injection through the offset apertures and the simplified fabrication of the axisymmetrical electrodes.

The reader will understand that the equation set forth herein is but one of several equations which may be used to describe an electrostatic field for focusing electrons upon the plurality of electrodes. Further, the number and shape of electrodes may be varied within the teachings of the present invention. For example, electrodes 814 and 816 could be eliminated and only electrode 812 be provided with an offset aperture 826. One or more electrodes 814 and 816 may be used with or without offset apertures 826 and 830. Electrode 812 could be dished like electrode 814 in some application. It will be understood that the heat caused by the electron beam 32 as it strikes the electrodes may be dissipated by liquid cooling or by fins or other suitable arrangements. Finally, the electron gun 36 and the vacuum device 40 which are utilized with the electron collector 10 of the present invention should not be limited by the devices shown schematically herein. Accordingly, the present invention should be limited only by the appended claims.

We claim:

1. An electron collector having a centerline for collecting spent electrons generated by the cathode of an electron gun after passage through a vacuum device, comprising:

a plurality of electrodes for collecting the spent electrons, each electrode having an axisymmetrical shape about said centerline and each electrode mounted in axisymmetrically spaced relationship along said centerline including first and last electrodes which form the front and back walls of an enclosure;

said first electrode and others of said plurality of electrodes having apertures therein through which said electrons pass, said apertures being offset from said centerline of said enclosure; and means for applying different consecutively smaller voltages with respect to said cathode to said first electrode and said plurality of electrodes to establish an axisymmetrical, electrostatic field for focusing said spend electrons upon different electrodes as said electrons enter said enclosure along a path formed by said apertures which path is at least partially off-axis to said centerline of said enclosure.

2. The electron collector of claim 1 wherein:

said electrode that forms said back wall of said enclosure is maintained at a voltage that is higher than the voltage maintained upon said cathode.

3. The electron collector of claim 1 wherein:

said plurality of electrodes that forms said first and last electrode include further second and third electrodes mounted between said first and last electrodes;

said second electrode has an aperture therein through which said electrons pass that is offset from said centerline of said enclosure; and said third electrode has an aperture therein through which said electrons pass that is symmetrically arranged about said centerline of said enclosure.

4. The electron collector of claim 3, wherein:

said third electrode and said last electrode, which forms said back wall of said enclosure, are maintained at the same voltage which is higher than the voltage maintained upon said cathode.

5. The electron collector of claim 1, wherein:

said electrons from said cathode enter said aperture in said first electrode along a path that is parallel to said centerline of said enclosure.

6. The electron collector of claim 1, wherein:

said electrons from said cathode enter said aperture in said first electrode along a path that is at an angle to said centerline of said enclosure.

7. A charged-particle collector for collecting charged particles comprising:

an enclosed region having a longitudinal axis passing through the center of said enclosed region into which the charged particles are directed; and a plurality of electrodes for collecting the charged particles, each of said electrodes being arranged about said longitudinal axis and having a surface area which is substantially symmetrical about said longitudinal axis, at least one of said electrodes also containing an aperture through which the charged particles are directed, said aperture being offset from said longitudinal axis.

8. The charged-particle collector of claim 7, wherein the charged particles are electrons emanating from a microwave tube.

9. The charged-particle collector of claim 7, wherein said enclosed region includes a front entry wall and an opposing back wall, and at least one of said electrodes is mounted within the region between said front entry wall and said opposing back wall.

10. The charged-particle collector of claim 7, wherein said aperture is circularly shaped.

11. The charged-particle collector of claim 9, wherein said front entry wall and said electrodes are each formed of metal in a generally cup-like configuration so as to nest into one another, and means are provided to electrically insulate said particle entry wall and said electrodes from each other.

12. The charged-particle collector of claim 7, wherein:

the charged particles emanate from a vacuum device connected to an electronic gun having a cathode for generating electrons;

said plurality of electrodes includes a first, second, third and fourth electrode;

said enclosed region includes an entry wall comprised of said first electrode;

said enclosed region includes a back wall comprised of said fourth electrode; and said charged particle collector further includes means for applying different consecutively smaller voltages with respect to said cathode to said first, second and third electrodes and for applying the same voltage to said forth electrode that is applied to said third electrode.

13. The charged-particle collector of claim 12 wherein the voltage applied to said third and forth electrodes is higher than the voltage of the cathode.

14. The charged-particle collector of claim 12 wherein:

the voltage applied to said first electrode is 30% to 65% of the cathode voltage with respect to ground;

the voltage applied to said second electrode is 55% to 85% of the cathode voltage with respect to ground; and the voltage applied to said third and fourth electrodes if 80% to 100% of the cathode voltage with respect to ground.

15. The charged-particle collector of claim 12 wherein:

said second electrode has an aperture which is offset from said longitudinal access; and said third electrode has an aperture which is symmetrical about said longitudinal access.

16. The charged-particle collector of claim 12 wherein said first, second, third and fourth electrodes create an electrostatic field which is a substantially axisymmetric field for focusing the electrons from the cathode on to said electrodes.

17. The charged-particle collector of claim 12, wherein said electrodes cooperate to define an electrostatic field V, defined by the equation:

$$V = \tfrac{3}{2}z + \tfrac{1}{2}z^2 - 1/12z^4 - \tfrac{1}{4}r^2 + \tfrac{1}{4}r^2z^2 - 1/32r^4$$

in an r, z-coordinate system, where z is the distance along said longitudinal access and r is the radial distance therefrom.

* * * * *